United States Patent [19]

Holló et al.

[11] Patent Number: 4,912,364

[45] Date of Patent: Mar. 27, 1990

[54] THREE-PHASE HIGH-PRESSURE GAS DISCHARGE LAMP FILLED WITH A GAS CONTAINING SODIUM OR A METAL-HALIDE

[75] Inventors: Sándor Holló, Eger; Zsolt Márton, Budapest; Balázs Nyiri, Budapest; János Szántó, Budapest, all of Hungary

[73] Assignee: Tungsram Részvénytársaság, Budapest, Hungary

[21] Appl. No.: 219,933

[22] Filed: Jul. 15, 1988

[30] Foreign Application Priority Data

Jul. 16, 1987 [HU] Hungary ..... 3248/87

[51] Int. Cl.[4] ..... H01J 61/073; H01J 61/30; H01J 61/36

[52] U.S. Cl. ..... 313/623; 313/631; 313/634; 313/636; 313/306

[58] Field of Search ..... 313/581, 306, 623, 636, 313/642, 638, 639, 631, 634

[56] References Cited

U.S. PATENT DOCUMENTS 2,459,516 1/1949 Francis et al. ..... 313/581
4,037,128 7/1977 Levin et al. ..... 313/581 X

FOREIGN PATENT DOCUMENTS 526401 9/1940 United Kingdom .
616404 1/1949 United Kingdom .
1039649 8/1966 United Kingdom .
1138913 1/1969 United Kingdom .
1280735 7/1972 United Kingdom .
1360269 7/1974 United Kingdom .

OTHER PUBLICATIONS

"Discharge Lamp", Appl. No. 55-2727 (Abstract), Matsushita Denko K.K., Japan, 11/1981.

*Primary Examiner*—Kenneth Wieder
*Attorney, Agent, or Firm*—Spencer & Frank

[57] ABSTRACT

A three-phase high-pressure gas discharge lamp comprising a discharge vessel (1) made of a translucent heat-resistant material. Three electrodes are arranged in the discharge vessel (1), each being fed from a separate phase of a three-phase supply system, each electrode including an electrode tip (7), an electrode stem (5) and an electrode head (6). The electrodes are arrnaged so that their electrode tips (7) occupy the vertices of an equilateral triangle fully enclosed in the discharge vessel (1). The discharge vessel (1) contains a filling consisting of a noble gas, mercury and a further additive selected from the group consisting of preferably sodium and a metal-halide.

17 Claims, 5 Drawing Sheets

THREE-PHASE HIGH-PRESSURE GAS DISCHARGE LAMP FILLED WITH A GAS CONTAINING SODIUM OR A METAL-HALIDE

BACKGROUND OF THE INVENTION

The invention relates to a high-pressure three-phase gas discharge lamp containing noble gas, mercury, sodium and/or metal-halide additives.

In the high-pressure, doped gas discharge lamps known and used so far the light of an arc discharge produced, between two cylindrically symmetrical electrodes fed from a single-phase supply network is utilized. The disadvantages of a lamp of this kind result from light modulation arc instabilities (e.g. convective side deflection of the arc in metal-halide and mercury vapour lamps), further from the reignition problems occuring at zero transition of current. The stroboscope effect resulting due to light modulation of single-phase gas discharge lamps is of special disadvantage when moving objects are to be illuminated and moving pictures or video records are taken.

To eliminate these drawbacks, gas discharge lamps fed from a three-phase supply, with three electrodes arranged in their discharge space are known from various publications.

UK patent specification GB 616404 discloses a heavy-duty three-phase lamp with a spherical quartz envelope filled with noble-gas, mercury and cadmium and/or zinc. The electrodes are accommodated in the envelope so that their heads "see each other", the heads being seated in the vertices of an imaginary equilateral triangle inscribed into said envelope.

German (laid open) Patent Application DE-OS 2 542 133 a three-phase discharge lamp, but designed to provide a discharge of linear pattern between the electrodes of the discharge vessel.

PCT International Application No. WO 83/041140 discloses a three phase discharge lamp including three electrodes accommodated in a discharge vessel having a very special shape and, in addition, a fourth electrode connected to the star point is built into the discharge space.

In East German Patent Application No. DD 215423, a low-pressure discharge lamp containing a layer of a luminophor is described, the discharge vessel being confined by planar surfaces and also having a fourth electrode connected to the star point of the three-phase electrode system.

In Japanese application JP 56-099965 (Kokai) a discharge lamp is described in which the three heated electrodes are located in a glass discharge vessel enclosed by planar lateral surfaces, but the discharge itself is also of linear shape.

All these lamps, however, have failed to find practical use, either because of their poor colour rendition (GB 614404), or because of the complicated shape of their discharge vessel or the requirement of adding a fourth electrode (WO 83/041140, DD 215423), or because, in spite of accommodating three electrodes in the discharge space, a linear discharge (DE 2542133, JP 56-099965A), instead of a spherical pattern, is provided by them.

A long-standing demand prevails, however, on the part of consumers of a high-pressure discharge lamp that is capable of providing illumination without giving rise to disturbing stroboscopic effects but yet has satisfactory colour rendition. The discharge lamps described in the patent specifications mentioned above fail to fulfil these requirements.

On the other hand, it has been recognized that the way to obtain a quasi-stationary spheroid plasma is by bringing about a spherical discharge in a discharge space filled with a substance ensuring good colour rendition, and where the time constants of the processes taking place are selected with a view to achieve this aim. It is important to make the discharge itself spherical rather than some rotating linear shape, because this is the only way of obtaining the required light source free of producing the undesired stroboscopic effects.

Further, by using a ceramic discharge vessel the possibility of setting up a three-phase, high-pressure sodium lamp containing a spheroid discharge plasma exists by properly arranging in the discharge space the three electrodes each fed from a single phase of the supply source. By proper arrangement it is meant that the electrode heads "see each other" and are sited in the vertices of an equilateral triangle inscribed in the discharge vessel.

SUMMARY OF THE INVENTION

Based on the foregoing recognitions, the present invention includes a three-phase high-pressure gas discharge lamp provided with a spherical shape discharge vessel made of some heat-resistant material enclosed, if necessary, in an external translucent envelope, and filled with an additive consisting of a noble gas, mercury and some other substance differing from mercury, and further comprising three electrodes, each consiting of a stem, fixed to the current inlet terminals, and fed from the respective phases of a three-phase voltage source and an electrode head, coated with an emitting layer if necessary, arranged so that the electrode tips constitute the vertices of an equilateral triangle inscribed in the outlines of the discharge vessel. In accordance with an advantageous feature of the present invention, the filling in this lamp additionally includes an additive differing from mercury, selected from the group consisting of sodium and a metal-halide.

In an advantageous embodiment of the discharge lamp, the vessel is made of quartz, and the current inlets and electrode stem sections are enclosed in a single trifurcated star-shaped flattening formed by three planes displaced by 120° with respect to each other. The shaping of the single-sided, trifurcated star-shaped flattening of the three-phase lamp is a novel form hitherto undescribed in technical literature. As regards its shape, it conforms functionally with the three-phase lamp, it can easily be made, and it satisfies the criteria of mass production.

In another advantageous embodiment of the invention the discharge lamp is enclosed in a quartz envelope and the three current inlets with the respective electrode stems attached to them are accommodated in a single planar flattening. In a further advantageous embodiment, one of the current inlets protrudes into the discharge space through a flattening arranged opposite a flattening common for the other two current inlets.

According to another advantageous embodiment of the invention, the sodium lamp is provided with a ceramic envelope, and all current inlets are isolated from each and other protrude into the discharge space through a single ceramic sealing element.

BRIEF DESCRIPTION OF THE DRAWINGS

In the following, the invention will be explained in more detail on the basis of examples with reference to the attached drawings. In the drawings

DESCRIPTION OF THE PREFERRED EMBODIMENTS

Figure 1:
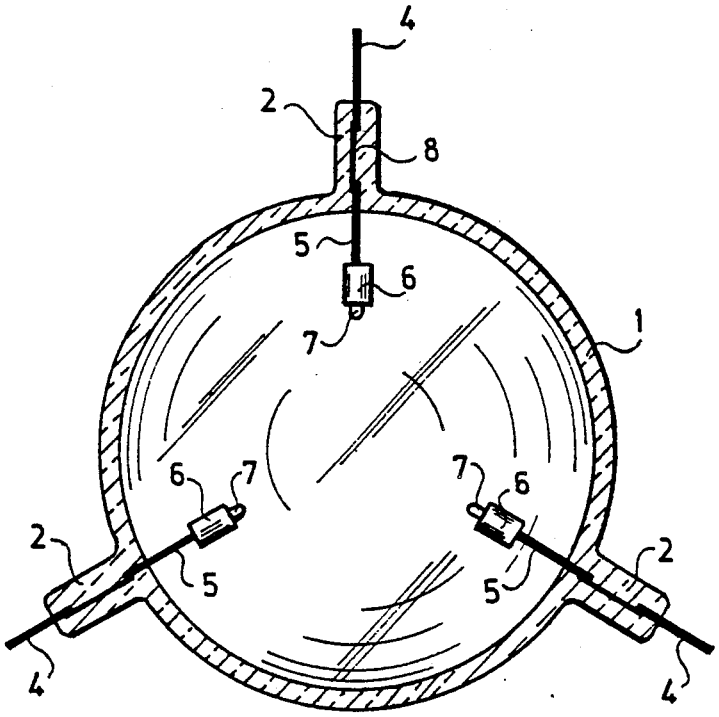
FIG. 1 shows a sectional view taken along a plane perpendicular to the axis of a three-phase metal-halide lamp, comprising three flattenings according to one embodiment of the invention.

In FIG. 1 there is shown a section of a near-spherical quartz discharge vessel 1, the section being taken along the plane in which current inlets 4 extend through flattenings 2, electrode stems 5, electrode heads 6 and electrode tips 7. Clearly shown in FIG. 1 are the three electrode tips 7, that define an imaginary equilateral triangle with its vortices coinciding with electrode tips 7. This imaginary triangle lies fully within the discharge vessel. The imaginary triangle nowhere touches or intersects the wall of the discharge vessel 1. Vacuum-tight fixing of the current inlet 4 is ensured by a foil 8 made of molybdenum. The discharge space of the lamp drawn in outline in FIG. 1 contains a noble gas, preferably argon, in addition to mercury and some known metal-halide, such as preferably disposium-iodide, thallium-iodide and sodium-iodide. Each of the three current inlets is connected to one phase of a supply network (not shown) through an ignition device (not shown) inserted between two phases and through a three-phase choke (not shown). By energizing the lamp, discharge is started, soon assuming an extended spheroid shape. Due to this shape, the surface of discharge is smaller in relation to its volume than in the case of a linear discharge, resulting in increased luminous efficiency. Also, due to the prevailing symmetry conditions, thermal gradients are smaller than with a linear discharge. As a result, the diffusion processes associated with the effects of segregation are somewhat restricted, and natural flow is reduced so that the flux of cations along the wall is weaker than in other places, resulting in a longer service life of the lamp.

Figure 2:
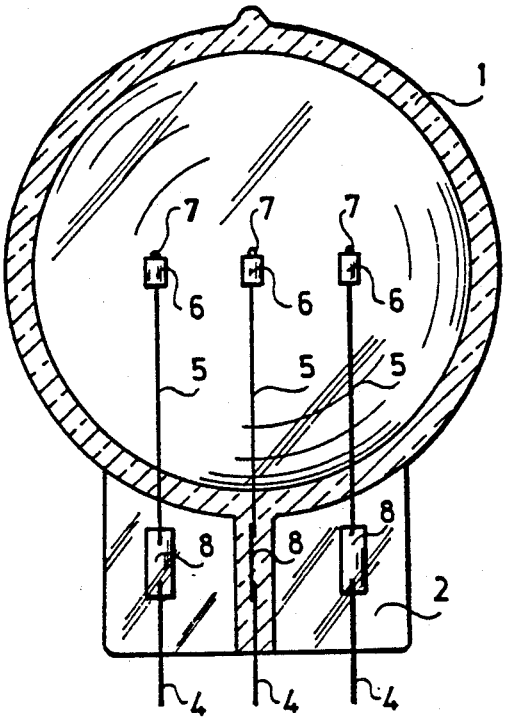
FIG. 2 shows a sectional view of another embodiment of a three phase metal-halide lamp according to the invention having one flattening on one side and formed to the shape of a trifurcated star.
Figure 2A:
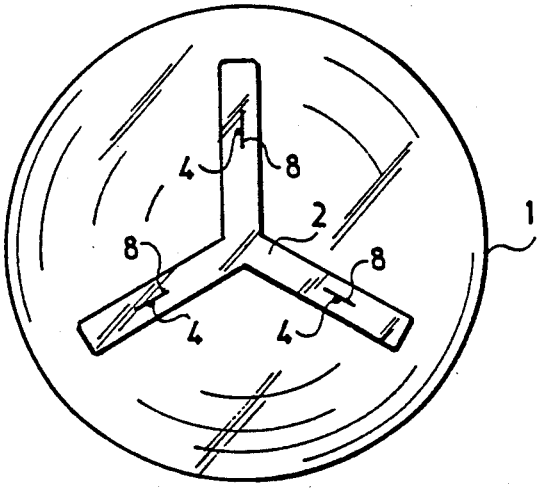
FIG. 2*a* shows a sectional view through the flattening of FIG. 2.

In the lamp design shown in FIGS. 2 and 2*a*, which also contains a spheroid-shape quartz discharge vessel 1, the electrode tips 7 are arranged for "seeing each other". Flattenings 2, on the other hand, are arranged on one side, their planes being displaced by 120° with respect to each other. The filling of the discharge vessel 1 consists of mercury, a known metal-halide, e.g. disprosium-iodide, thallium-iodide, sodium-iodide, and a noble gas, preferably argon. Connecting each phase of the current through an otherwise known ignition device and a three-phase choke to the respective electrode, the discharge is started. The spheroid-shape discharge will soon develop. The advantage of this lamp design is the simple way of connecting the electrodes to the current source. Further, this arrangement can be adopted with advantage in the design of small discharge lamps fed by high-frequency voltages, because risk of acoustic resonance is reduced as compared to that expected with single-phase cylindrically symmetrical designs.

Figure 3:
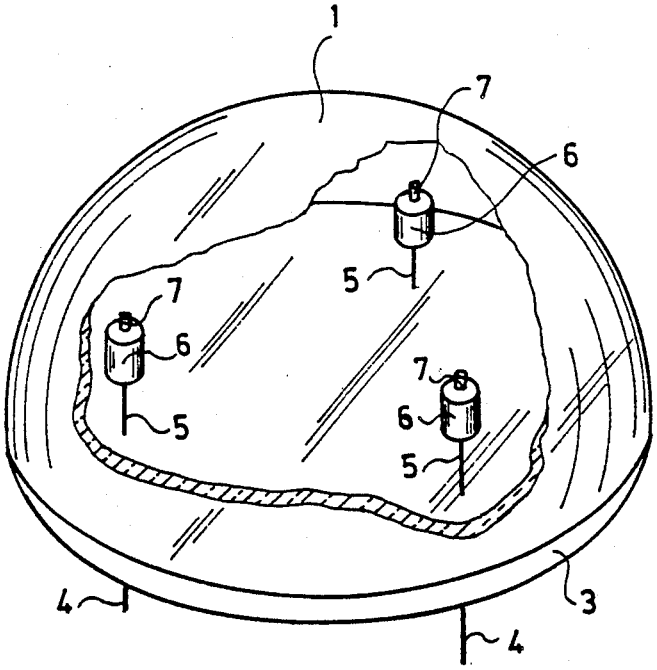
FIG. 3 shows a cut-away view of a three-phase sodium lamp according to another embodiment of the invention, exposing the inside of the discharge space.

FIG. 3 shows a cut-away view of a discharge vessel 1 made of aluminium-oxide ceramics and sealed with the same material from one side. The open end of the discharge vessel 1 is hermetically sealed by a ceramic plug 3 carrying current inlets 4 made of niobium and forming integral parts with their associated electrode stems 5 and electrode heads 6. It can be seen from FIG. 3 that the equilateral triangle defined by the electrode tips 7 lies fully inside the discharge vessel 1. The filling of discharge vessel 1 is a noble gas, preferably xenon containing a sodium amalgam additive. The three current inlets 4 are connected with the respective phases of the three-phase network through an otherwise known ignition device and choke. Soon after ignition the spheroid-shape discharge develops. Also with this lamp the light modulation is considerably reduced, since there is no zero transition of current due to the three-phase supply of the lamp,i.e. to the persistent presence of two electrodes between which a current path is incessantly available for maintaining the flow of discharge current.

Figure 4:
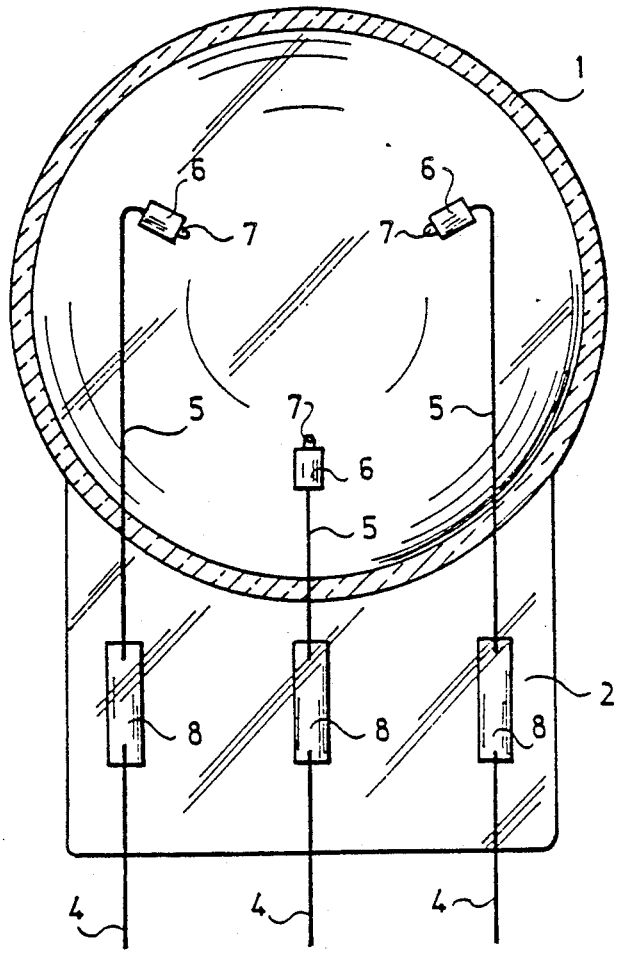
FIG. 4 is a longitudinal section of a three-phase metal-halide lamp flattened on one side to form a single plane according to another embodiment of the invention.

In FIG. 4 there is shown a lamp design incorporating a quartz discharge vessel 1 and three flattenings 2 for supporting current inlets 4 isolated from each other, arranged on one side of the discharge vessel. In this case, current inlets 4 and the respective sections of the electrode stems 5 are arranged in parallel, but two electrode stems 5 are bent, so as to form in the discharge vessel the required equilateral triangle defined by the electrode tips 7 and fully remaining within the discharge vessel 1. The filling of the discharge vessel 1 contains mercury, metal-halides, e.g. preferably disprosium-iodide, thallium-iodide and sodium-iodide, and further a noble gas, preferably argon. The advantage of this lamp is the possibility of its easy connection to the supply source.

Figure 5:
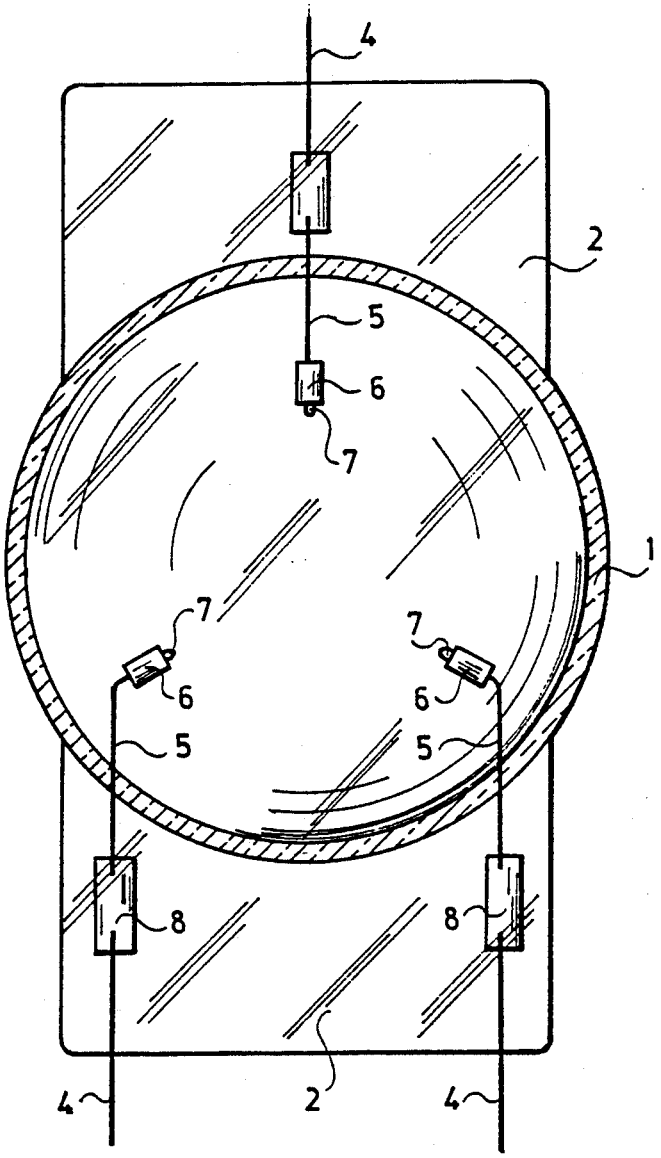
FIG. 5 shows a longitudinal section of a three-phase metal-halide lamp having its flattenings at opposite sides of the lamp according to a further embodiment of the invention.

FIG. 5 illustrates a lamp comprising a quartz discharge vessel 1 of substantially spherical shape, which carries the flattenings 2 arranged on two opposite sides of the discharge vessel 1. This permits adapting of an arrangement where the lamp can be fed from two sides. One of flattenings 2 carries two current inlets 4, two foils 8, two electrode stems 5, as well as two electrode heads 6 and two electrode tips 7 constituting integral units with the respective electrode stems 5, whereas flattening 2 on the opposite side carries one current inlet 4, one foil 8, one electrode stem 5 and, connected to it, one electrode head 6 and one electrode tip 7 mounted thereon. It can clearly be established from FIG. 5 that electrode tips 7 can be made see each other so as to define an imaginary equilateral triangle situated fully inside the substantially spherical discharge vessel 1. A further advantage of this embodiment results from the ease of its adaptation to known constructions and manufacturing methods of the light source industry.

A further advantage of the lamp according to the invention, is the improved readiness of reignition due to the absence of zero transitions of current and due to the spherical shape of the discharge. Its suitability for being used as a light source in reflector systems, e.g. in projector lamps, should also be pointed out. In addition by spherical-surface discharge the design of suitable armatures for such lamps is facilitated. A further general advantage of the metal-halide doped lamps over conventional variants, owing to the substantially spherical symmetry of their design is the possibility of omitting the costly and problematic heat-reflecting layers, indispensable with former conventional designs for maintaining wall temperatures within specified limits during operation.

The lamp according to the present invention can be manufactured for small ratings, whereas only high-pressure three-phase lamps of high thermal inertia have become known so far.

What we claim is:

1. A three-phase high-pressure gas discharge lamp comprising: a discharge vessel made of a translucent heat resistant material and a filling in said discharge vessel consisting of a noble gas, mercury and at least one further additive, an electrode arrangement consisting of three electrodes each fed from a separate phase of a three phase voltage source, each electrode comprising an electrode tip, an electrode stem attached to the respective current inlet and an electrode head, arranged so that the tips of said electrodes constitute the vertices of an imaginary equilateral triangle situated within said discharge vessel, wherein the filling in said discharge vessel is completed with at least one further additive selected from the group consisting of sodium and metal-halide.

2. The three-phase gas discharge lamp as claimed in claim 1, wherein said discharge vessel consists of quartz and said current inlets and the sections of said electrode stems are located in a single star-shaped flattening formed by three planes with angles of 120° between them.

3. The three-phase gas discharge lamp as claimed in claim 1, wherein said discharge vessel consists of aluminium-oxide or ittrium-oxide based ceramics and said current inlets and sections of said electrode stems are electrically isolated from each other, but located in a single ceramic sealing element.

4. The three-phase gas discharge lamp as claimed in claim 1, wherein said current inlets and the sections of said attached electrode stems attached to them are isolated from each other and accommodated in a single planar flattening.

5. The three-phase gas discharge lamp as claimed in claim 1, wherein two of said current inlets and two of said electrode stem sections are isolated from each other and accommodated in a single flattening, whereas the third of said current inlets (4) and of said electrode stem sections (5) are arranged in another flattening (2) arranged oppositely to the above mentioned flattening (2).

6. The three-phase gas discharge lamp as claimed in claim 1, wherein said discharge vessel is enclosed in an external envelope made of translucent material.

7. The three-phase gas discharge lamp as claimed in claim 1, wherein said electrode head is coated with an emissive material.

8. The three-phase gas discharge lamp as claimed in claim 1, wherein said metal-halide is selected from the group including dysprosium-iodide and thallium-iodide.

9. A three-phase high pressure gas discharge lamp comprising:

a discharge vessel made of a translucent heat resistant material;

a filling in said discharge vessel consisting of a noble gas, mercury and at least one further additive selected from the group consisting of sodium and a metal-halide;

three current inlets; and an electrode arrangment consisting of three electrodes each fed from a separate phase of a three-phase voltage source, each electrode comprising an electrode tip, an electrode stem attached to a respective one of the current inlets and an electrode head, said electrodes being arranged so that the tips of said electrodes constitute the vertices of an imaginary equilateral triangle disposed within said discharge vessel.

10. A three-phase gas discharge lamp as claimed in claim 9, wherein said discharge vessel consist of quartz and includes a single star-shaped flattening formed by three planes each separated by 120° from the other planes, said current inlets and sections of said electrode stems being located in said single star-shaped flattening.

11. A three-phase gas discharge lamp as claimed in claim 9, wherein said discharge vessel comprises one of aluminum-oxide and ittrium-oxide based ceramics; and further including a single ceramic sealing element sealing said discharge vessel; said current inlets and sections of said electrode stems being electrically isolated from each other and located in said ceramic sealing element.

12. A three-phase gas discharge lamp as claimed in claim 9, wherein said discharge vessel includes a single planar flattening and said current inlets and sections of said electrode stems are isolated from each other and disposed in said single planar flattening.

13. A three-phase gas discharge lamp as claimed in claim 9, wherein said discharge vessel includes a first flattening and a second flattening arranged on an opposite side from said first flattening, two of said current inlets and sections of two of said electrodes being isolated from each other and disposed in said first flattening and the third of said current inlets and a section of the third of said electrode stems being arranged in said second flattening.

14. A three-phase gas discharge lamp as claimed in claim 9, and further including an external envelope made of a translucent material enclosing said discharge vessel.

15. A three-phase gas discharge lamp as claimed in claim 9, and further including an emissive material coating each said electrode head.

16. A three-phase gas discharge lamp as claimed in claim 9, wherein said metal-halide is selected from the group including dysprosium-iodide and thallium-iodide.

17. A three-phase gas discharge lamp as claimed in claim 9, wherein said discharge vessel has a spherical shape.

* * * * *